US006225856B1

(12) United States Patent
Toth

(10) Patent No.: US 6,225,856 B1
(45) Date of Patent: May 1, 2001

(54) LOW POWER BANDGAP CIRCUIT

(75) Inventor: Michael S. Toth, Allentown, PA (US)

(73) Assignee: Agere Systems Cuardian Corp., Miami Lakes, FL (US)

( * ) Notice: Subject to any disclaimer, the term of this patent is extended or adjusted under 35 U.S.C. 154(b) by 0 days.

(21) Appl. No.: 09/364,440

(22) Filed: Jul. 30, 1999

(51) Int. Cl.[7] ..... G05F 1/46

(52) U.S. Cl. ..... 327/539; 327/535; 327/513; 323/313; 323/315; 323/907

(58) Field of Search ..... 327/538, 539, 327/530, 535, 513; 323/313, 315, 907

(56) References Cited

U.S. PATENT DOCUMENTS 4,849,684 * 7/1989 Sonntag et al. ..... 323/313
5,519,308 * 5/1996 Gilbert ..... 323/313
5,614,816 * 3/1997 Nahas ..... 327/539
5,619,163 4/1997 Koo ..... 327/539
5,631,551 5/1997 Scaccianoce et al. ..... 323/313
5,712,590 1/1998 Dries et al. ..... 327/539
5,867,012 * 2/1999 Tuthill ..... 323/313
5,892,388 4/1999 Chiu ..... 327/543
5,900,772 * 5/1999 Somerville et al. ..... 327/538
5,900,773 * 5/1999 Susak ..... 327/539
5,912,580 * 6/1999 Kimura ..... 327/530

* cited by examiner

*Primary Examiner*—Kenneth B. Wells
*Assistant Examiner*—Terry L. Englund
(74) *Attorney, Agent, or Firm*—Schnader Harrison Segal & Lewis, LLP

(57) ABSTRACT

A low power band gap circuit which uses the thermal properties of MOS devices to compensate for bipolar device behavior and provide temperature independent voltage and current sources.

7 Claims, 4 Drawing Sheets

LOW POWER BANDGAP CIRCUIT

FIELD OF THE INVENTION

This invention relates to electronic circuit design, more particularly to a circuit for producing a temperature independent voltage and current supply.

BACKGROUND

In many electronic applications, a reference circuit is required to provide highly accurate voltage or current. Bandgap reference circuits are commonly known and used in the art of analog design to provide a reference voltage in, for example, analog to digital (A/D) converters. Such circuits are preferable over other designs because of their low power dissipation, their ability to be used in low voltage applications, and because they provide a high level of overall stability. Bandgap voltage reference circuits are typically designed to provide first order temperature compensation.

A bandgap voltage reference operates by adding a differential voltage, derived from biasing two bipolar base-emitter junctions at different current densities, to a single base-emitter junction voltage. The differential voltage has a positive temperature coefficient, while the single base-emitter junction voltage has a negative temperature coefficient. By adjusting the magnitude of one of the temperature coefficient terms, and combining the two terms in an adder circuit, the output of the adder will be temperature independent to the first order.

Various bandgap circuits designs are known and used in the art to provide a supply independent and temperature-stable voltage. However, these designs are limited in their applicability either by their high power requirements or by the complexity of their design which requires large amounts of valuable real estate on an integrated circuit. Accordingly, it is desirable to provide a relatively simple bandgap circuit design capable of providing a temperature-stable voltage while having low power supply requirements.

DETAILED DESCRIPTION

This invention provides a temperature independent voltage reference circuit having low power supply requirements. The circuit uses the thermal properties of MOS devices to compensate for bipolar device behavior and is preferably designed to operate down to 2.1V with a total current requirement of about 30 $\mu$A. Additionally, the circuit may include a current source using the same network as the voltage source without requiring additional current.

The circuit may be used in DAA line interface circuitry for modem applications where the voltage output node of the bandgap is buffered and then divided into three reference voltages to be used by the D-to-A converter and the A-to-D converter. The current output node of the bandgap is used to bias the rest of the DAA circuitry with a temperature independent voltage.

Figure 1:
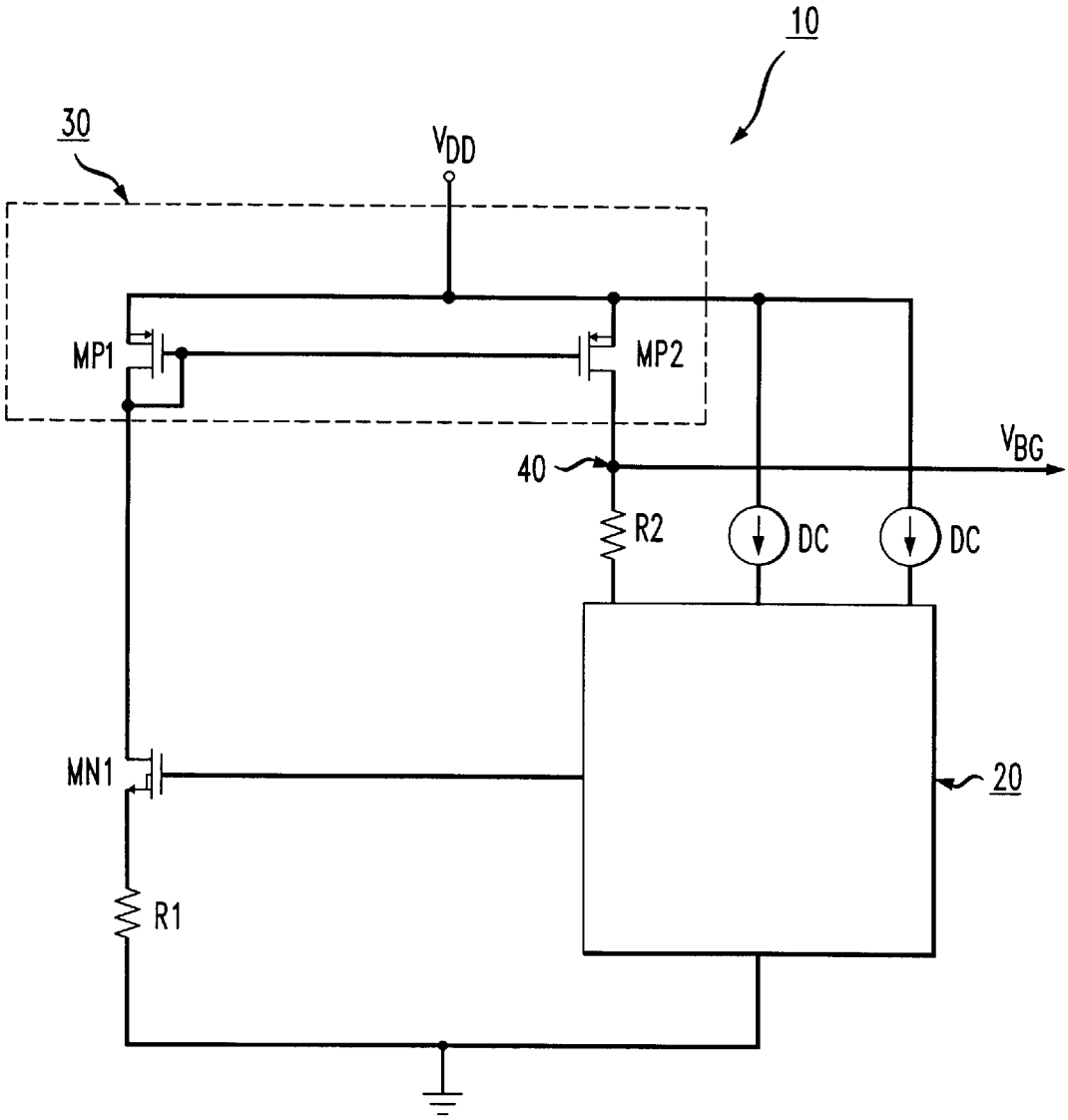
FIG. 1 is a schematic representation of one embodiment of the invention.

One embodiment in accordance with the invention is illustrated in FIG. 1. Circuit 10 includes PTAT voltage generator circuit 20 for generating a proportional-to-absolute-temperature (PTAT) voltage, an NMOS transistor MN1, and a first resistor R1 connected between the source terminal of the NMOS transistor MN1 and ground. The PTAT voltage from PTAT voltage generator circuit 20 is supplied to the gate terminal of the NMOS transistor MN1. A current mirror 30 is included to supply a substantially equal current to the drain terminal of NMOS transistor MN1 and to a second resistor R2 connected between current mirror 30 and PTAT voltage generator circuit 20. A temperature independent voltage $V_{BG}$ is produced at a node 40 between current mirror 30 and second resistor R2.

Current mirror 30 preferably includes a first PMOS transistor MP1 having a source terminal coupled to a voltage supply $V_{DD}$, and a gate terminal and a drain terminal coupled to the drain terminal of NMOS transistor MN1. Further, current mirror 30 includes a second PMOS transistor MP2, having a source terminal coupled to a voltage supply $V_{DD}$, a drain terminal coupled to the second resistor R2, and a gate terminal coupled to the gate terminal and the drain terminal of the first PMOS transistor MP1.

Figure 2:
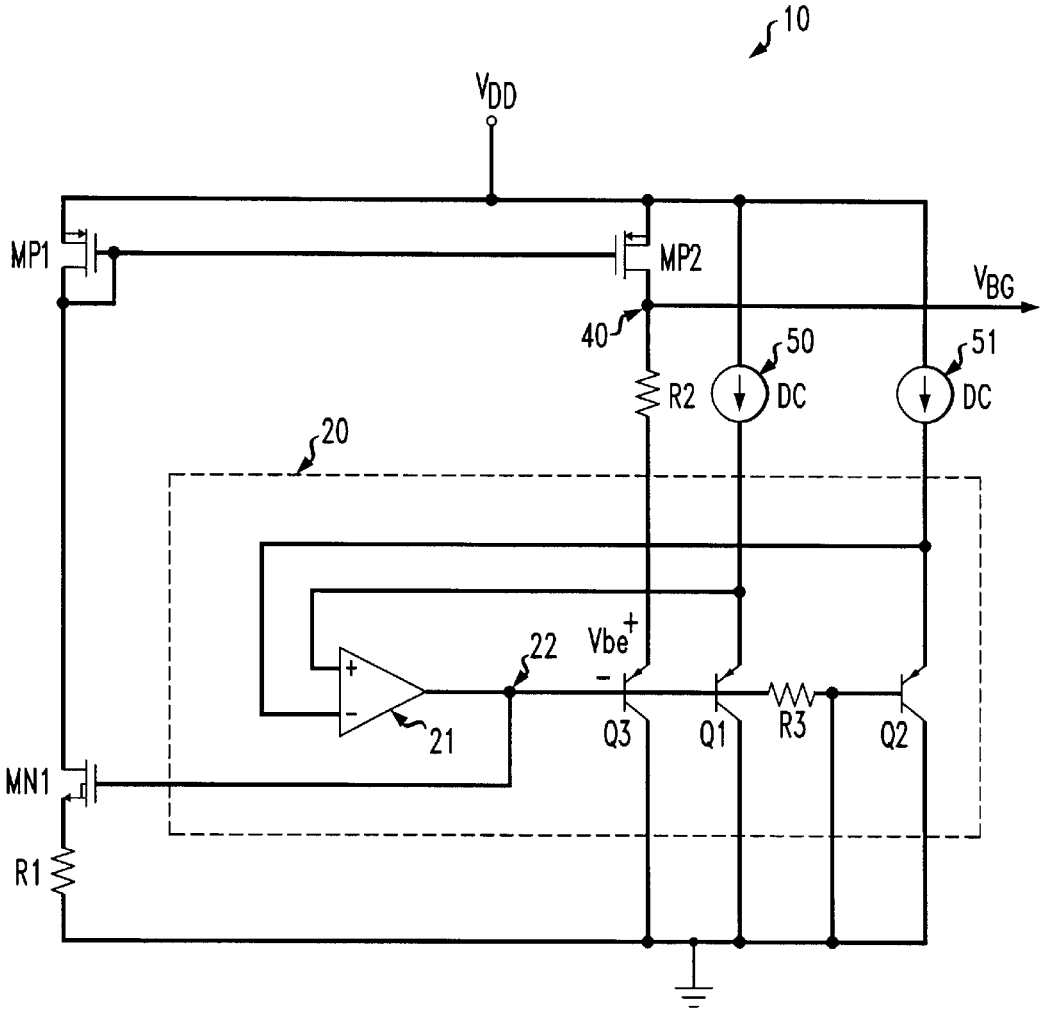
FIG. 2 is a schematic representation of another embodiment of the invention.

As shown in FIG. 2, PTAT voltage generator circuit 20 for generating a PTAT voltage may include an operational amplifier 21, a third resistor R3, a first transistor Q1, a second transistor Q2, and a third transistor Q3. Operational amplifier 21 is used to create a PTAT voltage across the third resistor R3. The first transistor Q1 has an emitter terminal coupled to a first current source 50 and to a positive input of operational amplifier 21. The second transistor Q2 has an emitter terminal coupled to a second current source 51 and to a negative input terminal of operational amplifier 21. The third transistor Q3 has an emitter terminal coupled to the second resistor R2, a base terminal coupled to a base terminal of the first transistor Q1 and to an output of operational amplifier 21. The collector terminal of the third transistor Q3 is coupled to a collector terminal of the first transistor Q1 and to a base terminal and a collector terminal of the second transistor Q2, and to ground. The third resistor R3 is connected between the base terminal of the first transistor Q1 and the base terminal of the second transistor Q2. The PTAT voltage is produced at a node 22 between the output of operational amplifier 21 and the base terminal of the third transistor Q3.

Transistors Q1 and Q2 are preferably stacked together to double the change in the base-emitter voltage $V_{be}$ of the third transistor Q3, while increasing the noise by only about 3 dB. Accordingly, transistors Q1, and Q2 in FIG. 2 preferably represent two stacked bipolar devices.

Figure 3:
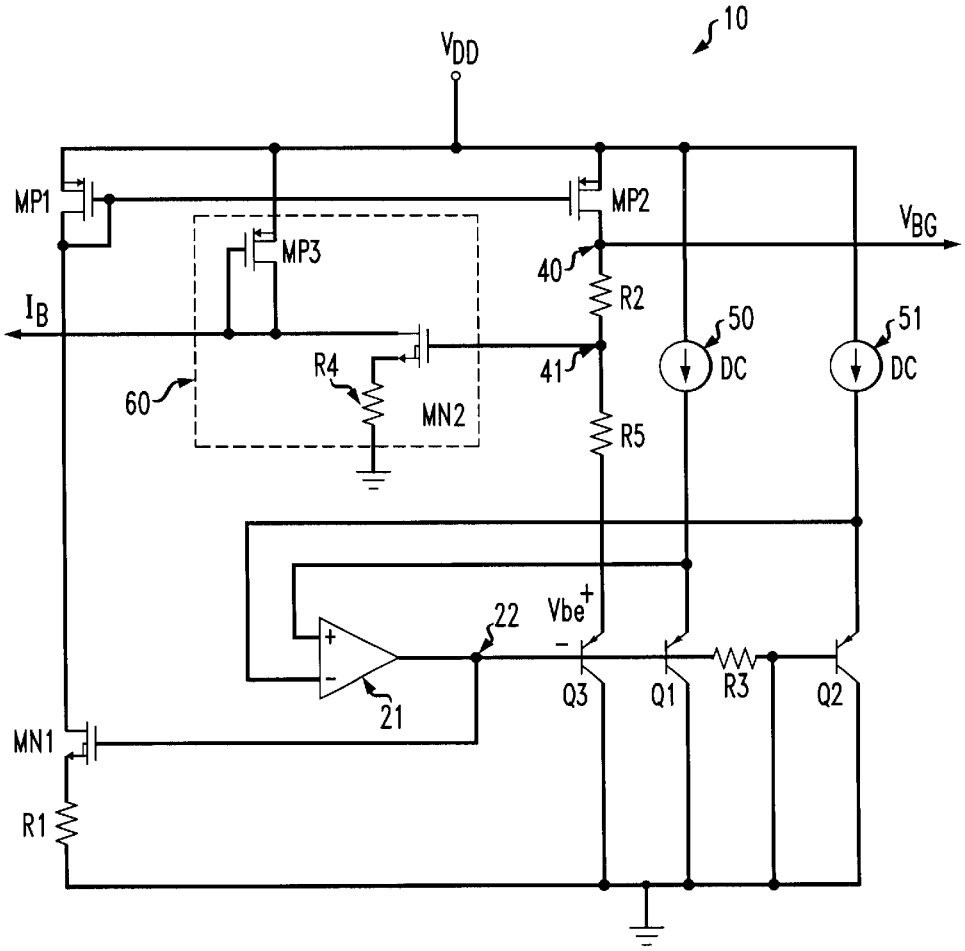
FIG. 3 is a schematic representation of yet another embodiment of the invention.

Another embodiment of the invention shown in FIG. 3, includes a temperature independent current source 60. This design is advantageous in that it provides a current source which uses the same network as the voltage source shown in FIGS. 1 and 2, without requiring additional current to set up the current biasing.

The current source 60 includes a second NMOS transistor MN2, a third PMOS transistor MP3 and a fourth resistor R4. A fifth resistor R5 is connected between second resistor R2 and the emitter terminal of the third transistor Q3. The second NMOS transistor MN2 has a gate terminal connected to a node 41 between the second resistor R2 and the fifth resistor R5.

The gate terminal and the drain terminal of the third PMOS transistor MP3 are coupled to the drain terminal of the second NMOS transistor MN2. The source terminal of the third PMOS transistor MP3 is coupled to voltage source $V_{DD}$. A fourth resistor R4 is connected between the source terminal of the second NMOS transistor MN2 and ground.

The voltage divider ratio for the second resistor R2 and the fifth resistor R5 is set such that the rate of change in voltage at the node between the second resistor R2 and the fifth resistor R5 is substantially equal to the change in the gate-source voltage of the second NMOS transistor MN2, producing a temperature independent current $I_B$ through the fourth resistor R4.

As with FIG. 2, transistors Q1, and Q2 in FIG. 3 preferably represent two stacked bipolar devices.

In operation, the delta voltage developed across the third resistor R3, on node 22, rises at a rate of about 1 mV/deg.C. The current through the second resistor R2 and the fifth resistor R5 is increased with temperature to provide an additional about 1 mV/deg.C temperature coefficient. Current through the second resistor R2 and the fifth resistor R5 is set by the voltage across the first resistor R1 and the PMOS mirrors MP1 and MP2. This design increases the rate of change in the current through the second resistor R2 and the fifth resistor R5 by combining the temperature change in the gate-source voltage of the first NMOS transistor MN1 with the PTAT voltage. The gate-source voltage across the first NMOS transistor MN1 falls at a rate of about 0.5 mV/deg.C causing the voltage at the source of the first NMOS transistor MN1 to increase at a rate of about 1.5 mV/deg.C. The increase in current through the first NMOS transistor MN1 creates an increasing voltage across the second resistor R2 and the fifth resistor R5 which cancels to the first order the falling base-emitter voltage $V_{be}$ of the third transistor Q3.

The voltage out of the circuit VBG can be expressed as:

$$V_{BG} = \frac{R2 + R5}{R1}(V_{BB} + Vgs_{MN1}) + V_{BB} + V_{be}$$

where $V_{BB}$ is the voltage at node 22, R1, R2 and R5 are the resistance of the first, second and fifth resistors, respectively, $Vgs_{MN1}$ is the gate-source voltage of the first NMOS transistor MN1, and $V_{be}$ is the base-emitter voltage of the third transistor Q3.

Referring to FIG. 3, the current $I_B$ from current source 60 can be expressed as:

$$I_B = \frac{1}{R4}\left(V_{be} + \left(1 + \frac{R5}{R1}\right)V_{BB} - Vgs_{MN2} - \frac{R5}{R1}Vgs_{MN1}\right)$$

where $V_{be}$ is the base-emitter voltage of the third transistor Q3, R1, R4 and R5 are the resistance of the first, fourth and fifth resistors respectively, $V_{BB}$ is the voltage at node 22, $Vgs_{MN2}$ is the gate-source voltage of the second NMOS transistor MN2, and $Vgs_{MN1}$ is the gate-source voltage of the first NMOS transistor MN1.

Figure 4:
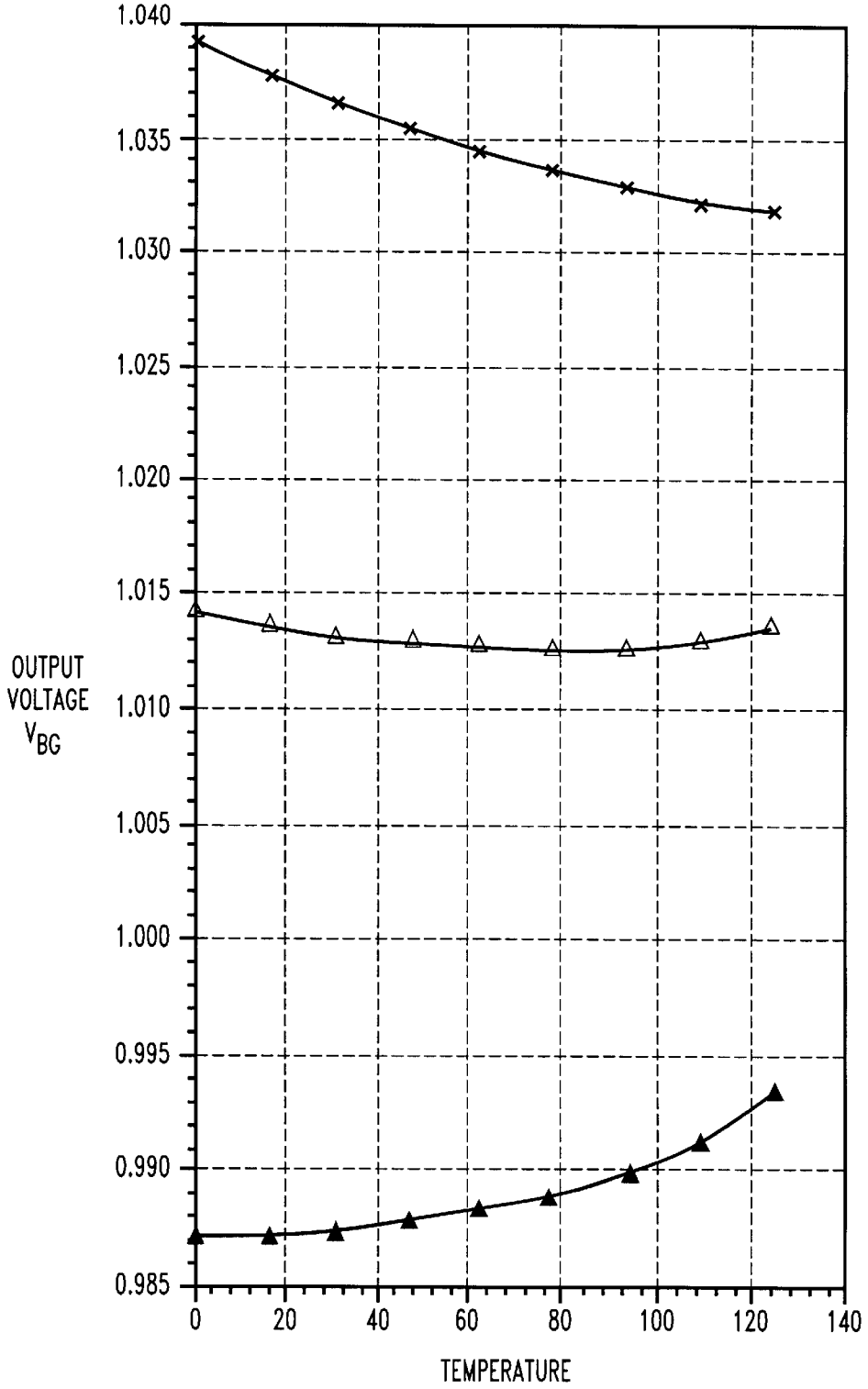
FIG. 4 plots the variation in output voltage over temperature range.

As shown in FIG. 4, the curvature of the bandgap voltage ($V_{BG}$) is positive rather than the typical negative curvatures for conventional bandgap designs. The plots in FIG. 4 show a variation in output voltage of 34 mdB over a temperature range of 0 deg. C to 125 deg. C.

A method for generating a temperature independent voltage in accordance with the invention includes the steps of: a) generating a PTAT voltage; b) applying the PTAT voltage to an adjustment circuit which amplifies said PTAT voltage and modifies the rate of change of the PTAT voltage with temperature and generates an output; and c) adding the adjustment circuit output, said PTAT voltage, and an inverse PTAT voltage to generate the temperature independent voltage. The method of the invention may further include: a) supplying a voltage from the adjustment circuit to a second adjustment circuit; generating a temperature independent current from the second adjustment circuit; wherein the voltage from the adjustment circuit is set such that the rate of change of the voltage from the adjustment circuit compensates for the effects of temperature on the second adjustment circuit.

Although the invention has been described in its preferred embodiments with reference to the accompanying drawings, it can be readily understood that the invention is not limited to the specific details, representative devices and examples shown and described. Accordingly, various changes and modifications may be made without departing from the spirit and scope of the general inventive concept as defined by the appended claims and their equivalents.

What is claimed is:

1. A bandgap reference circuit comprising:

a PTAT voltage generator circuit for generating a PTAT voltage;

an NMOS transistor;

a first resistor connected between a source terminal of said NMOS transistor and ground; and a current mirror for supplying substantially equal current to the drain terminal of said NMOS transistor and to a second resistor connected between said current mirror and said PTAT voltage generator circuit;

wherein said PTAT voltage is supplied to a gate terminal of said NMOS transistor; and wherein a temperature independent voltage is produced at a node between said current mirror and said second resistor.

2. The circuit of claim 1, wherein said current mirror comprises:

a first PMOS transistor having a source terminal coupled to a voltage supply, and a gate terminal and a drain terminal coupled to said drain terminal of said NMOS transistor; and a second PMOS transistor having a source terminal coupled to said voltage supply, a drain terminal coupled to said second resistor, and a gate terminal coupled to said gate terminal and said drain terminal of said first PMOS transistor.

3. The circuit of claim 1, wherein said PTAT voltage generator circuit comprises:

an operational amplifier;

a first transistor having an emitter terminal coupled to a first current source and to a positive input of said operational amplifier;

a second transistor having an emitter terminal coupled to a second current source and to a negative input terminal of said operational amplifier;

a third transistor having an emitter terminal coupled to said second resistor, a base terminal coupled to a base terminal of said first transistor and to an output of said operational amplifier, and a collector terminal coupled to a collector terminal of said first transistor and to a base terminal and a collector terminal of said second transistor and to ground; and a third resistor connected between said base terminal of said first transistor and said base terminal of said second transistor;

wherein said PTAT voltage is produced at a node between said output of said operational amplifier and said base terminal of said third transistor.

4. A circuit as in claim 3, wherein said first transistor and said second transistor each comprise a plurality of stacked bipolar devices.

5. A circuit as in claim 3 wherein said current mirror comprises:

a first PMOS transistor having a source terminal coupled to a voltage supply, and a gate terminal and a drain terminal coupled to said drain terminal of said NMOS transistor; and a second PMOS transistor having a source terminal coupled to said voltage supply, a drain terminal coupled to said second resistor, and a gate terminal coupled to said gate terminal and said drain terminal of said first PMOS transistor; and further comprising a current source having a fifth resistor connected between said second resistor and said PTAT voltage generator circuit;

a second NMOS transistor having a gate terminal connected to a node between said second resistor and said fifth resistor;

a third PMOS transistor having a gate terminal and a drain terminal coupled to a drain terminal of said second NMOS transistor, and having a source terminal coupled to said voltage supply; and a fourth resistor connected between a source terminal of said second NMOS transistor and ground;

wherein a voltage divider ratio for said second resistor and said fifth resistor is set such that the rate of change in voltage at said node between said second resistor and said fifth resistor is substantially equal to the change in the gate-source voltage of said second NMOS transistor; and wherein a temperature independent current is produced through said fourth resistor.

6. A band gap reference circuit comprising:

an operational amplifier;

a first transistor having an emitter terminal coupled to a first current source and to a positive input of said operational amplifier;

a second transistor having an emitter terminal coupled to a second current source and to a negative input terminal of said operational amplifier;

a third transistor having a base terminal coupled to a base terminal of said first transistor and to an output of said operational amplifier, and a collector terminal coupled to a collector terminal of said first transistor and to a base terminal and a collector terminal of said second transistor and to ground; and a third resistor connected between said base terminal of said first transistor and said base terminal of said second transistor;

a first NMOS transistor having a gate terminal coupled to said output of said operational amplifier;

a first resistor connected between a source terminal of said first NMOS transistor and ground;

a first PMOS transistor having a source terminal coupled to a voltage supply, and a gate terminal and a drain terminal coupled to a drain terminal of said first NMOS transistor;

a second PMOS transistor having a source terminal coupled to said voltage supply, and a gate terminal coupled to said gate terminal and said drain terminal of said first PMOS transistor;

a second resistor connected between a drain terminal of said second PMOS transistor and a fifth resistor, said fifth resistor being connected between said second resistor and an emitter terminal of said third transistor;

a second NMOS transistor having a gate terminal connected to a node between said second resistor and said fifth resistor;

a third PMOS transistor having a gate terminal and a drain terminal coupled to a drain terminal of said second NMOS transistor, and having a source terminal coupled to said voltage supply;

a fourth resistor connected between a source terminal of said second NMOS transistor and ground;

wherein a PTAT voltage is produced at a node between said output of said operational amplifier and said base terminal of said third transistor, and applied to said gate terminal of said first NMOS transistor; and wherein a temperature independent voltage is produced at a node between said second PMOS transistor and said second resistor; and wherein a voltage divider ratio for said second resistor and said fifth resistor is set such that the rate of change in voltage at said node between said second resistor and said fifth resistor is substantially equal to the change in the gate-source voltage of said second NMOS transistor; and wherein a temperature independent current is produced through said fourth resistor; and wherein said first transistor and said second transistor each comprise a plurality of stacked bipolar devices; and wherein the temperature independent voltage can be expressed by the following relationship:

$$V_{BG} = \frac{R2 + R5}{R1}(V_{BB} + Vgs_{MN1}) + V_{BB} + V_{be}$$

where $V_{BB}$ is the voltage at said node between said output of said operational amplifier and said base terminal of said third transistor, R1 is the resistance of said first resistor, R2 is the resistance of said second resistor, R5 is the resistance of said fifth resistor, $Vgs_{MN1}$ is the gate-source voltage of said first NMOS transistor, and $V_{be}$ is the base-emitter voltage of said third transistor;

wherein the temperature independent current can be expressed by the following equation:

$$I_B = \frac{1}{R4}\left(V_{be} + \left(1 + \frac{R5}{R1}\right)V_{BB} - Vgs_{MN2} - \frac{R5}{R1}Vgs_{MN1}\right)$$

where $V_{be}$ is the base-emitter voltage of said third transistor, R1 is the resistance of said first resistor, R4 is the resistance of said fourth resistor, R5 is the resistance of said fifth resistor, $V_{BB}$ is the voltage at said node between said output of said operational amplifier and said base terminal of said third transistor, $Vgs_{MN2}$ is the gate-source voltage of said second NMOS transistor, and $Vgs_{MN1}$ is the gate-source voltage of said first NMOS transistor.

7. A method for generating a temperature independent voltage, comprising the steps of:

generating a PTAT voltage;

modifying said PTAT voltage by subtracting a voltage drop across gate-source terminals of an NMOS transistor;

generating a current from voltage at the source terminal of said NMOS transistor, the rate at which said current changes with respect to temperature being modified by said NMOS transistor;

scaling said modified PTAT voltage by using a current mirror and a resistor connected to said current mirror;

generating a falling PTAT voltage across the base-emitter junction of a bipolar transistor; and adding said scaled modified PTAT voltage to said falling PTAT voltage to generate said temperature independent voltage.

* * * * *

UNITED STATES PATENT AND TRADEMARK OFFICE

CERTIFICATE OF CORRECTION

PATENT NO. : 6,225,856 B1
DATED : May 1, 2001
INVENTOR(S) : Michael S. Toth

It is certified that error appears in the above-identified patent and that said Letters Patent is hereby corrected as shown below:

Title page,
Item [73] Assignee, please change "Cuardian" to -- Guardian --.

Signed and Sealed this

Twenty-first Day of May, 2002

*Attest:*

*Attesting Officer*

JAMES E. ROGAN
*Director of the United States Patent and Trademark Office*